United States Patent [19]

Seifert

[11] 4,414,681

[45] Nov. 8, 1983

[54] ROTARY ANODE X-RAY TUBE

[75] Inventor: Gerd Seifert, Spardorf, Fed. Rep. of Germany

[73] Assignee: Siemens Aktiengesellschaft, Berlin & Munich

[21] Appl. No.: 320,734

[22] Filed: Nov. 12, 1981

[30] Foreign Application Priority Data

Nov. 19, 1980 [DE] Fed. Rep. of Germany ..... 3043670

[51] Int. Cl.[3] ..... H01J 35/04

[52] U.S. Cl. ..... 378/144; 378/131

[58] Field of Search ..... 378/144, 131; 313/16

[56] References Cited

U.S. PATENT DOCUMENTS 3,878,395 4/1975 Seifert et al. ..... 250/402

*Primary Examiner*—David K. Moore

*Assistant Examiner*—Robert E. Wise

*Attorney, Agent, or Firm*—Hill, Van Santen, Steadman & Simpson

[57] ABSTRACT

In an exemplary embodiment, an anode assembly is magnetically mounted free of contact. In order to carry off the anode current, on a part rotating with the anode assembly, an auxiliary cathode is arranged opposite which a stationary auxiliary anode is disposed. The auxiliary cathode is an oxide cathode which is centrically arranged on the rotary anode assembly and opposite which a stationary heater is disposed.

4 Claims, 4 Drawing Figures

ROTARY ANODE X-RAY TUBE

BACKGROUND OF THE INVENTION

The invention relates to a rotary anode x-ray tube comprising an anode which is mounted magnetically without contact, and means for carrying off the anode current.

A rotary anode x-ray tube of this type is described in U.S. Pat. No. 3,878,395. In the case of this rotary anode x-ray tube, the bearing for the rotary anode proceeds by means of a magnetic bearing which provides support axially and radially without contact. The drive motor for the anode comprises a magnetically soft magnetic material which is at the exterior of the rotary anode assembly, and a stator winding at the exterior wall of the tube envelope and surrounding the magnetic material. The magnetic bearing includes an exterior electromagnet whose winding encircles additional magnetically soft material associated with the anode assembly. In the case of this known rotary anode x-ray tube, for the carrying off of the anode current, a mechanical contact is provided between a shaft rotating with the anode and a stationary portion. In the case of this contact, brief interruptions can occur which result in sparking. In addition, metal abrasion occurs.

SUMMARY OF THE INVENTION

The object underlying the invention resides in producing a rotary anode x-ray tube of the type initially cited in which the anode current is carried off from the anode without mechanical contact.

In accordance with the invention, this object is achieved in that, on a part rotating with the anode, at least one auxiliary cathode is arranged with which a stationary auxiliary anode is associated, and that the auxiliary cathode is an oxide cathode which is centrically arranged on the rotary anode and opposite which in a stationary heater. In the case of the inventive rotary anode x-ray tube, the carrying off of the anode current proceeds via an auxiliary diode which is arranged on the anode side; i.e., in a contact-free fashion. Also, for the heating of the auxiliary cathode no rotating parts or mechanical contacts of any kind are necessary.

The invention shall be explained in greater detail in the following on the basis of exemplary embodiments illustrated on the accompanying drawing sheets; and other objects, features and advantages will be apparent from this detailed disclosure and from the appended claims.

DETAILED DESCRIPTION

Figure 1:
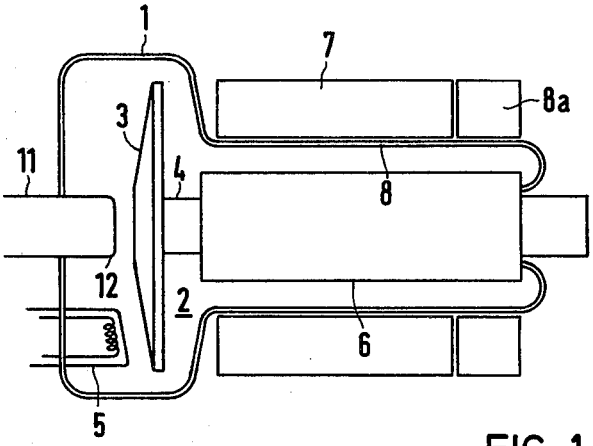
FIG. 1 illustrates the significant parts of a rotary anode x-ray tube according to the invention.

In FIG. 1, 1 designates the glass housing of an x-ray tube in which a rotary anode 2 rotates. The rotary anode 2 comprises an anode plate 3 which is mounted on a shaft 4 and with which a cathode 5 is associated in a known fashion, so that the cathode 5 delivers the electron current necessary for generating the x-radiation. The shaft 4 is connected with the rotor 6 which drives the anode 2 and permits a magnetic bearing. This signifies that the anode 2 during its rotation is magnetically held in suspension. For this purpose, a stationary magnetic winding 7 is provided which surrounds the neck 8 of the glass housing 1. For the drive of the rotary anode 2 a drive winding 8*a* is present.

Figure 2:
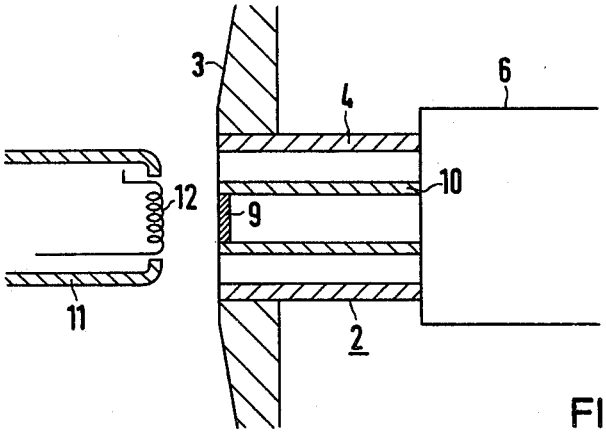
FIG. 2 illustrates a section of the rotary anode x-ray tube according to FIG. 1.

In the case of the rotary anode x-ray tube illustrated in FIG. 1, the anode 2 during its rotation has no mechanical contact whatsoever with stationary parts. In order that also the high voltage can be supplied in a contact-free fashion, according to FIG. 2, in the center of the anode plate 3, at its end face, an oxide cathode 9 is arranged in a tube 10. This oxide cathode 9 forms, with a stationary anode 11, a diode via which the anode current of the x-ray tube flows. In order to heat the oxide cathode 9 a heating coil 12 is disposed at a minimum distance opposite the latter, which heating coil 12 is likewise stationary and is surrounded by the stationary auxiliary anode 11. The heating coil 12 is connected in a known fashion to a filament voltage generator.

Figure 3:
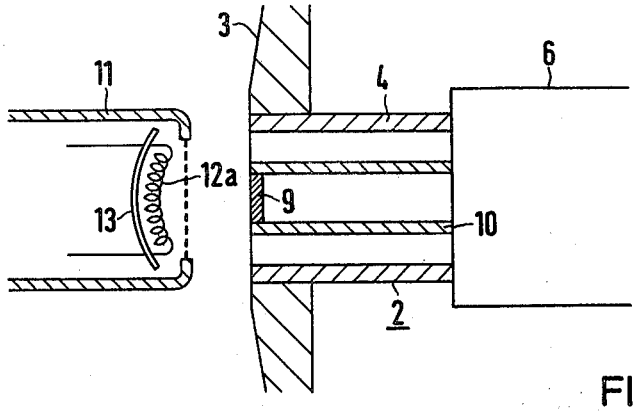
FIG. 3 illustrates a variant of the embodiment according to FIG. 2.

In the embodiment of the invention according to FIG. 3, a heater coil 12*a* is provided which is surrounded by a heat reflecting mirror 13 which concentrates the thermal radiation in the direction of the oxide cathode 9.

Figure 4:
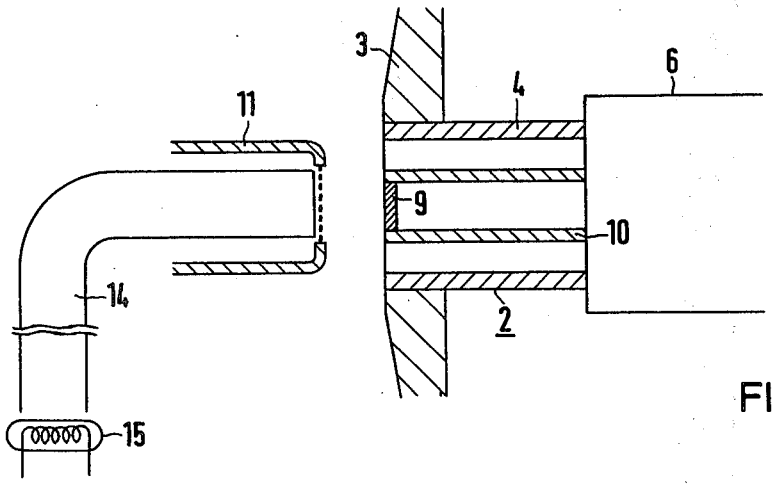
FIG. 4 illustrates a further variant of the embodiment according to FIG. 2.

FIG. 4 illustrates an exemplary embodiment in which the heating energy for the oxide cathode 9 is transmitted by means of a light guide 14 which has a light transmissive port at its output end which output end is mounted in the center of the auxiliary anode 11. Heating energy is generated by a light source 15 which provides an intensive light output; for example, a discharge lamp or a laser.

It will be apparent that many modifications and variations may be effected without departing from the scope of the novel concepts and teachings of the present invention.

SUPPLEMENTARY DISCUSSION

In each of the illustrated embodiments the auxiliary cathode 9 and tube 10 are structurally connected with the shaft 4 and anode plate 3 for joint rotation with the rotor 6, when the rotor 6 is driven by the stator winding 8*a*. Furthermore there is provided an electrically conductive path for direct current flow between the annular x-ray producing anode region of plate 3 (which is aligned for cooperation with the cathode 5, FIG. 1) and the auxiliary cathode 9, FIGS. 2, 3, and 4.

As shown, for example, in the German Patent Application No. P 30 43 046.7, filed Nov. 14, 1980, the shaft 4 may be connected to a disk within the rotor assembly 6 of the present case. The disk, in the present case, may mount the inner tubular shaft 10, and may be carried by a ring of insulating material (designated by reference numeral seven in the German patent application). Thus, the parts 3, 4, 9, and 10 and the disk hereof are insulated from the magnetic material of rotor 6, and from the stationary journal (corresponding to stationary journal twelve of the German patent application).

I claim as my invention:

1. A rotary anode x-ray tube comprising an anode assembly (2), mounted magnetically without contact, and including a rotary anode part (3) rotating with the anode assembly, and means for carrying off the anode current, characterized in that, on the rotary anode part (3), rotating with the anode assembly (2), at least one auxiliary cathode (9) is arranged as part of said means, said means further comprising a stationary auxiliary anode (11) operatively associated with said auxiliary cathode (9), and that the auxiliary cathode (9) is an oxide cathode which is centrically arranged on the anode assembly (2), a stationary heater (12, 12*a*, 14, 15) being disposed opposite said auxiliary cathode for supplying heat thereto.

2. A rotary anode x-ray tube according to claim 1, characterized in that the heater is a stationary heater coil (12, 12*a*) which is surrounded by the stationary auxiliary anode (11).

3. A rotary anode x-ray tube according to claim 1, characterized in that a mirror (13) is disposed behind the heater (12*a*) for directing radiant heat toward the auxiliary cathode (9).

4. A rotary anode x-ray tube according to claim 1, characterized in that the heater has a light source (15) for generating intensive light.

* * * * *